US010759023B2

(12) United States Patent
Meuler et al.

(10) Patent No.: US 10,759,023 B2
(45) Date of Patent: Sep. 1, 2020

(54) ABRASIVE ARTICLES AND RELATED METHODS

(71) Applicant: 3M INNOVATIVE PROPERTIES COMPANY, St. Paul, MN (US)

(72) Inventors: Adam J. Meuler, Woodbury, MN (US); Daniel J. Schmidt, Woodbury, MN (US); Yugeun P. Yang, St. Paul, MN (US); Paul D. Graham, Woodbury, MN (US); David A. Nettleship, Atherstone (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/066,536

(22) PCT Filed: Dec. 29, 2016

(86) PCT No.: PCT/US2016/069141
§ 371 (c)(1),
(2) Date: Jun. 27, 2018

(87) PCT Pub. No.: WO2017/117364
PCT Pub. Date: Jul. 6, 2017

(65) Prior Publication Data

US 2019/0015950 A1 Jan. 17, 2019

Related U.S. Application Data

(60) Provisional application No. 62/273,050, filed on Dec. 30, 2015.

(51) Int. Cl.

| | |
|---|---|
| ***B24D 3/00*** | (2006.01) |
| ***B24D 3/34*** | (2006.01) |
| ***B24D 11/00*** | (2006.01) |

(52) U.S. Cl.
CPC ..... *B24D 3/004* (2013.01); *B24D 3/346* (2013.01); *B24D 11/00* (2013.01); *B24D 11/001* (2013.01)

(58) Field of Classification Search
CPC ..... B24D 3/004; B24D 3/346; B24D 11/00; B24D 11/001
See application file for complete search history.

(56) References Cited

U.S. PATENT DOCUMENTS

| | | | |
|---|---|---|---|
| 3,619,150 | A | 11/1971 | Royden |
| 3,922,464 | A | 11/1975 | Silver |

(Continued)

FOREIGN PATENT DOCUMENTS

| | | |
|---|---|---|
| DE | 3516661 | 11/1985 |
| EP | 2679332 | 1/2014 |

(Continued)

OTHER PUBLICATIONS

Decker, "Kinetic study and new applications of UV radiation curing", Macromolecular rapid communications, 2002, vol. 23, pp. 1067-1093.

(Continued)

*Primary Examiner* — Pegah Parvini

(57) ABSTRACT

Provided are abrasive articles that include a plurality of layers, in the following order: a backing; an abrasive layer; and a supersize coat. The supersize coat contains a metal salt of a long-chain fatty acid and clay particles dispersed therein. Advantageously, the clay particles enhance the optical clarity of the supersize coat, allowing printed abrasive articles to be made with thicker supersize coatings. The addition of clay was also found to improve cut performance of the abrasive article relative to articles in which the clay particles are absent.

13 Claims, 2 Drawing Sheets

(56) References Cited

U.S. PATENT DOCUMENTS

| | | | | |
|---|---|---|---|---|
| 4,642,126 | A | 2/1987 | Zador | |
| 4,645,711 | A | 2/1987 | Winslow | |
| 4,652,274 | A | 3/1987 | Boettcher | |
| 4,737,593 | A | 4/1988 | Ellrich | |
| 4,988,554 | A | 1/1991 | Peterson | |
| 5,037,453 | A | 8/1991 | Narayanan | |
| 5,108,463 | A | 4/1992 | Buchanan | |
| 5,116,676 | A | 5/1992 | Winslow | |
| 5,342,419 | A | 8/1994 | Hibbard | |
| 5,628,952 | A | 5/1997 | Holmes | |
| 5,648,425 | A | 7/1997 | Everaerts | |
| 5,663,241 | A | 9/1997 | Takamatsu | |
| 5,700,302 | A | 12/1997 | Stoetzel | |
| 5,702,811 | A | 12/1997 | Ho | |
| 5,704,952 | A | 1/1998 | Law | |
| 5,721,289 | A | 2/1998 | Karim | |
| 5,804,610 | A | 9/1998 | Hamer | |
| 5,833,724 | A | 11/1998 | Wei | |
| 5,914,299 | A | 6/1999 | Harmer | |
| 6,057,382 | A | 5/2000 | Karim | |
| 6,083,290 | A | 7/2000 | Ikeda | |
| 6,153,302 | A | 11/2000 | Karim | |
| 6,183,677 | B1 | 2/2001 | Usui | |
| 6,187,836 | B1 | 2/2001 | Oxman | |
| 6,254,954 | B1 | 7/2001 | Bennett | |
| 6,354,929 | B1 | 3/2002 | Adefris | |
| 6,359,027 | B1 | 3/2002 | Dahlke | |
| 6,372,323 | B1 | 4/2002 | Kobe | |
| 6,682,574 | B2 | 1/2004 | Carter | |
| 6,773,474 | B2 | 8/2004 | Koehnle | |
| 6,835,220 | B2 | 12/2004 | Swei | |
| 7,329,175 | B2 | 2/2008 | Woo | |
| 7,713,604 | B2 | 5/2010 | Yang | |
| 8,506,752 | B2 | 8/2013 | Vandal | |
| 2002/0182955 | A1 | 12/2002 | Weglewski | |
| 2003/0079415 | A1* | 5/2003 | Carter | C08G 12/12 51/295 |
| 2003/0114078 | A1 | 6/2003 | Mann | |
| 2009/0155596 | A1 | 6/2009 | Kropp | |
| 2010/0022170 | A1 | 1/2010 | Starling | |
| 2011/0162287 | A1* | 7/2011 | Cai | B24D 3/004 51/298 |
| 2013/0219800 | A1 | 8/2013 | Guiselin | |
| 2013/0263520 | A1* | 10/2013 | Houga | B24D 3/28 51/298 |
| 2014/0113131 | A1 | 4/2014 | Yamamoto | |
| 2014/0120344 | A1 | 5/2014 | Yamamoto | |
| 2015/0030839 | A1 | 1/2015 | Satrijo | |

FOREIGN PATENT DOCUMENTS

| | | |
|---|---|---|
| EP | 2722376 | 4/2014 |
| EP | 3012288 | 4/2016 |
| EP | 2868692 | 10/2017 |
| GB | 2492304 | 12/2012 |
| JP | 55127482 | 10/1980 |
| JP | 2000008025 | 1/2000 |
| WO | WO 1994-029399 | 12/1994 |
| WO | WO 1996-021704 | 7/1996 |
| WO | WO 2009-059900 | 5/2009 |
| WO | WO 2014-172139 | 10/2014 |
| WO | WO 2014-172332 | 10/2014 |
| WO | WO 2016-035170 | 3/2016 |
| WO | WO 2016-073227 | 5/2016 |
| WO | WO 2016-085791 | 6/2016 |
| WO | WO 2016-195970 | 12/2016 |
| WO | WO 2016-196561 | 12/2016 |
| WO | WO 2017-116941 | 7/2017 |
| WO | WO 2017-117163 | 7/2017 |
| WO | WO 2017-117356 | 7/2017 |

OTHER PUBLICATIONS

Mark, "Encyclopedia of Polymer Science and Technology", Wiley-interscience publication, 1986, vol. 6, pp. 322-380.

International Search report for PCT International Application No. PCT/US2016/069141 dated May 10, 2017, 6 pages.

* cited by examiner

ABRASIVE ARTICLES AND RELATED METHODS

CROSS REFERENCE TO RELATED APPLICATIONS

This application is a national stage filing under 35 U.S.C. 371 of PCT/US2016/069141, filed Dec. 29, 2016, which claims the benefit of U.S. Application No. 62/273,050, the disclosure of which is incorporated by reference in its/their entirety herein.

FIELD OF THE INVENTION

Provided are abrasive articles, along with related compositions and methods of use. The provided abrasive articles can be useful in, for example, abrading soft materials such as painted automotive surfaces.

BACKGROUND

Abrasive articles are widely used by both consumers, manufacturers, and service providers to perform sanding and finishing operations on almost any given workpiece. Potential workpieces are diverse and can have surfaces made of plastic, wood, metal, or even ceramic materials.

Printed flexible abrasives in particular offer unique benefits to both manufacturers and consumers. The ability to impart an image to an abrasive can enhance its appearance and provide branding or promotional information. The inclusion of printed information can also be effective in communicating technical details to the end user, such as its grit size. Printing ornamental and functional images directly on the abrasive is often preferred over placing such images on product packaging because these products can easily become separated from their packaging.

Disposing a printed image onto an abrasive article can be technically challenging, because the components of an abrasive article often have limited translucency. These articles are generally made by affixing abrasive particles onto some sort of backing, which can be either rigid or flexible. In some cases, the abrasive particles are uniformly mixed with a polymeric binder to form a slurry, which is then coated onto the backing and cured to provide the final product. Alternatively, the abrasive particles can be directly adhered to the surface of the backing by partially embedding them in curable resins called "make" and "size" coats. An advantage of the latter approach is that the abrasive particles can be provided in a preferred orientation on the working surface, enabling material to be removed efficiently.

Methods for making abrasive articles that show graphic images visible from the abrasive-side of the article have been reported elsewhere, for example in provisional U.S. Patent Application Ser. No. 62/076,874 (Graham et al.).

SUMMARY

When abrading soft materials, performance can diminish as debris created by the sanding, or swarf, begins to coalesce and fill the spaces between the abrasive grains. Swarf loading can prevent the abrasive from effectively contacting the work surface and reduce cut performance. This problem can be mitigated by applying a "supersize" coat of a soapy composition, or surfactant, on top of the abrasive particles. The supersize coat can significantly reduce the accumulation of swarf in the areas around the abrasive particles, thus improving both cut performance and the expected lifetime of the abrasive product.

Abrasive performance was found to improve as the thickness of the supersize coat was increased. It was discovered, however, that the supersize coat tends to lose its optical clarity as its thickness increases. As a result, the supersize layer can significantly obscure any images printed on the abrasive article. This dilemma is answered by incorporating a clay additive into the composition of the supersize coat. Advantageously, the modified coatings not only provide greater optical clarity but also improve cut performance for longer periods of time compared with coatings where the clay additive is absent. Moreover, the addition of clay enables use of thicker supersize coats that further enhance abrasive performance.

In a first aspect, an abrasive article is provided. The abrasive article comprises a plurality of layers, in the following order: a backing; an abrasive layer; and a supersize coat comprising a metal salt of a long-chain fatty acid and having clay particles dispersed therein.

In a second aspect, a supersize composition is provided, comprising: a metal salt of a long-chain fatty acid; clay particles; and a solvent.

In a third aspect, a method of making an abrasive article is provided comprising: dispersing in a solvent the following components to provide a dispersion: clay particles; a metal salt of a long-chain fatty acid; and optionally, a polymeric binder; and coating the dispersion onto an abrasive layer.

Figure 1:
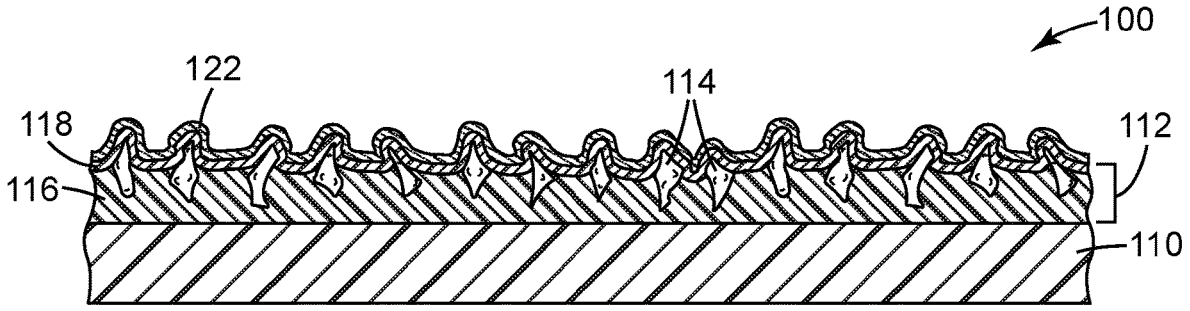
FIGS. 1-5 are side cross-sectional views of abrasive articles according to various exemplary embodiments.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. Figures may not be drawn to scale.

Definitions

As used herein:

"particle aspect ratio" refers to the ratio between the longest and the shortest dimension of the particle; and "particle diameter" refers to the longest dimension of the particle.

DETAILED DESCRIPTION

Abrasive Article Constructions

Figure 2:
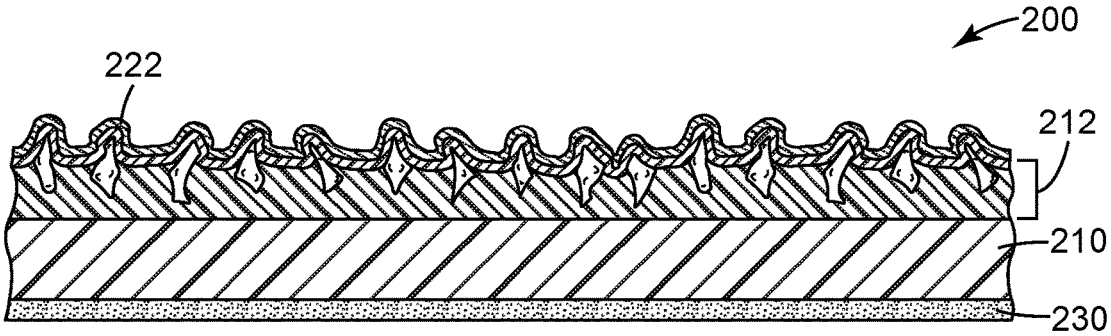

An exemplary abrasive article is illustrated according to one embodiment in FIG. 1 and herein referred to by the numeral 100. As shown, the abrasive article 100 includes a plurality of layers. From the bottom to the top, these layers generally include: a backing 110, an abrasive layer 112, and a supersize coat 122. The abrasive layer 112 is itself multilayered and includes a make coat 116, abrasive particles 114, and a size coat 118. Technical details concerning each of these layers are described in sections below. FIG. 2, like FIG. 1, shows an abrasive article 200 having a backing 210, abrasive layer 212, and supersize coat 222. The abrasive article 200 additionally has a continuous attachment layer 230 that extends across and directly contacts a major surface of the backing 210 facing away from the abrasive layer 212.

In the depicted embodiment, the attachment layer 230 is a removable pressure-sensitive adhesive, but this is merely exemplary.

Figure 3:
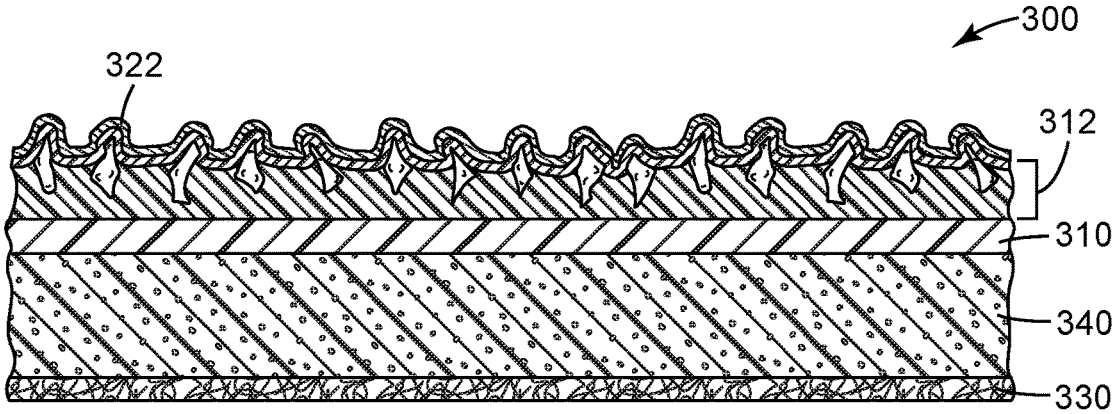

FIG. 3, like FIGS. 1 and 2, shows an abrasive article 300 having a backing 310, abrasive layer 312, and supersize coat 322. Like the abrasive article 200 in FIG. 2, the abrasive article 300 has an attachment layer 330. Here, the attachment layer 330 is part of a hook-and-loop attachment mechanism. A polymeric compressible foam 340 is interposed between the backing 310 and the attachment layer 330. Optionally but not shown, one or more additional layers could be disposed between any of the above layers to help adhere layers to each other, provide a printed image, act as a barrier layer, or serve any other purpose known in the art. By providing compressibility to the abrasive article 300, the compressible foam 340 can enable a more uniform contact with the workpiece to the abraded, and particularly so where the workpiece has non-planar contours. As a further option, the backing 310 and compressible foam 340 could be consolidated into a single layer that serves both functions.

Figure 4:
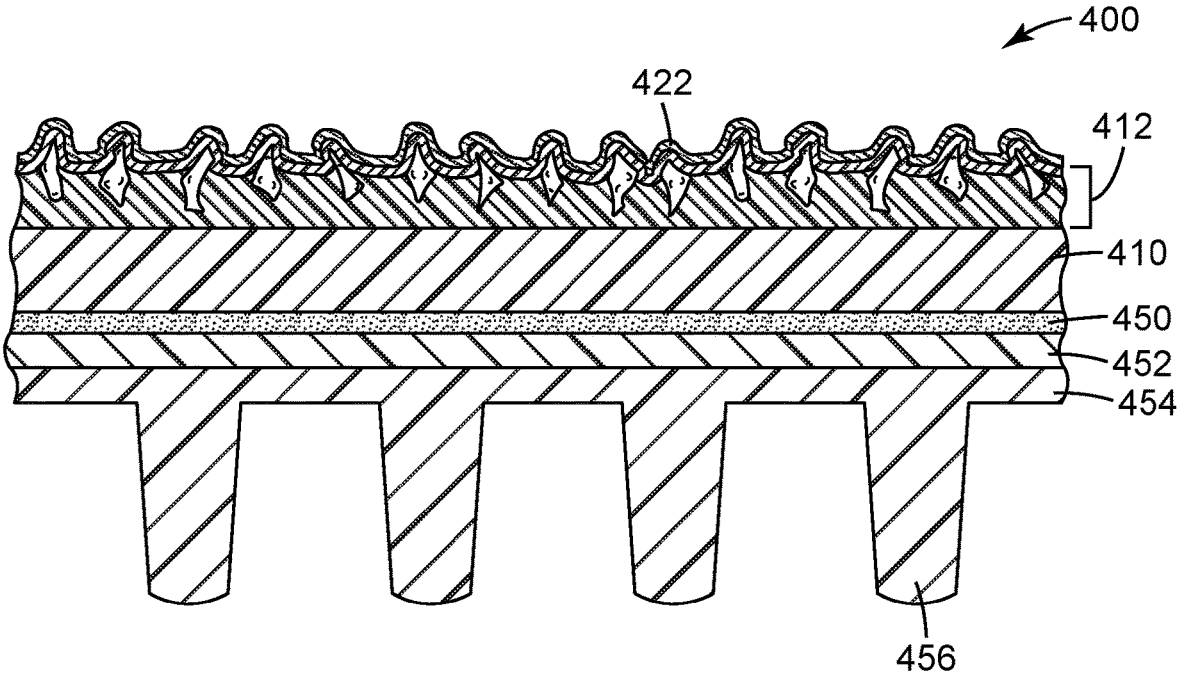

FIG. 4, like FIGS. 1-3, shows an abrasive article 400 having a backing 410, abrasive layer 412, and supersize coat 422. The abrasive article 400 further includes an adhesive layer 450 bonding the backing 410 to an underlying reinforcing layer 452, which is in turn adhered to a gripping layer 454. The gripping layer 454 includes integral protrusions 456 that extend outwardly from the backing and assist the operator in handling the abrasive article 400. To provide improved handling of the abrasive article 400, it is beneficial for the gripping layer 454 to be made from an elastomeric polymer, and preferably elastomeric polymers having a Shore A hardness ranging from 5 to 90. Further information concerning useful materials and geometries for the gripping layer 454 are described in U.S. Pat. No. 6,372,323 (Kobe et al.) and co-pending International Patent Application No. PCT/US15/61762 (Graham et al.).

Figure 5:
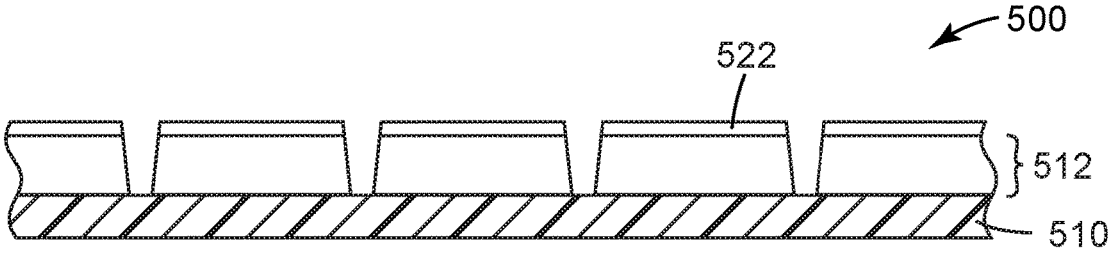

FIG. 5, like FIGS. 1-4, shows an abrasive article 500 having a backing 510, abrasive layer 512, and supersize coat 522. The abrasive article 500 differs from the previous ones in that the abrasive layer 512 is comprised of discontinuous, or discrete, islands of a hardened abrasive composite. Such a composite can be made by uniformly mixing abrasive particles with a binder to form a viscous slurry. This slurry can then be cast and appropriately hardened (for example, using a thermal or radiation curing process) onto a backing 510 to obtain the abrasive layer 512, as shown in the figure.

In some embodiments, the abrasive slurry is cast between the underlying film and a mold having tiny geometric cavities prior to hardening. After hardening, the resulting abrasive coating is molded into a plurality of tiny, precisely shaped abrasive composite structures affixed to the underlying film. The hardening of the binder can be achieved by a curing reaction triggered by heat or exposure to actinic radiation. Examples of actinic radiation include, for example, an electron beam, ultraviolet light, or visible light.

It is to be understood that one or ordinary skill may add or remove layers with respect to any of the embodiments depicted in FIGS. 1-5 for convention purposes without departing from the spirit of the present disclosure.

Backings

The aforementioned abrasive articles generally include a backing, such as any of backings 110, 210, 310 410, 510 above. The backing may be constructed from any of a number of materials known in the art for making coated abrasive articles. Although not necessarily so limited, the backing can have a thickness of at least 0.02 millimeters, at least 0.03 millimeters, 0.05 millimeters, 0.07 millimeters, or 0.1 millimeters. The backing could have a thickness of up to 5 millimeters, up to 4 millimeters, up to 2.5 millimeters, up to 1.5 millimeters, or up to 0.4 millimeters.

The backing is preferably flexible and may be either solid (as shown in FIG. 1) or porous. Flexible backing materials include polymeric film (including primed films) such as polyolefin film (e.g., polypropylene including biaxially oriented polypropylene, polyester film, polyamide film, cellulose ester film), polyurethane rubber, metal foil, mesh, foam (e.g., natural sponge material or polyurethane foam), cloth (e.g., cloth made from fibers or yarns comprising polyester, nylon, silk, cotton, and/or rayon), scrim, paper, coated paper, vulcanized paper, vulcanized fiber, nonwoven materials, combinations thereof, and treated versions thereof. The backing may also be a laminate of two materials (e.g., paper/film, cloth/paper, film/cloth). Cloth backings may be woven or stitch bonded. In some embodiments, the backing is a thin and conformable polymeric film capable of expanding and contracting in transverse (i.e. in-plane) directions during use.

Preferably, a strip of such a backing material that is 5.1 centimeters (2 inches) wide, 30.5 centimeters (12 inches) long, and 0.102 millimeters (4 mils) thick and subjected to a 22.2 Newton (5 Pounds-Force) dead load longitudinally stretches at least 0.1%, at least 0.5%, at least 1.0%, at least 1.5%, at least 2.0%, at least 2.5%, at least 3.0%, or at least 5.0%, relative to the original length of the strip. Preferably, the backing strip longitudinally stretches up to 20%, up to 18%, up to 16%, up to 14%, up to 13%, up to 12%, up to 11%, or up to 10%, relative to the original length of the strip. The stretching of the backing material can be elastomeric (with complete spring back), inelastic (with zero spring back), or some mixture of both. This property helps promote contact between the abrasive particles 114 and the underlying workpiece, and can be especially beneficial when the workpiece includes raised and/or recessed areas.

Useful backing materials are generally conformable. Highly conformable polymers that may be used in the backing include certain polyolefin copolymers, polyurethanes, and polyvinyl chloride. One particularly preferred polyolefin copolymer is an ethylene-acrylic acid resin (available under the trade designation "PRIMACOR 3440" from Dow Chemical Company, Midland, Mich.). Optionally, ethylene-acrylic acid resin is one layer of a bilayer film in which the other layer is a polyethylene terephthalate ("PET") carrier film. In this embodiment, the PET film is not part of the backing itself and is stripped off prior to using the abrasive article 100. While it is possible to strip the PET from the ethylene-acrylic acid resin surface, the ethylene-acrylic acid resin and the PET can also be bonded such that these two layers stay together during use of the abrasive article. In some embodiments, the backing has a modulus of at least 10, at least 12, or at least 15 kilogram-force per square centimeter ($kgf/cm^2$). In some embodiments, the backing has a modulus of up to 200, up to 100, or up to 30 $kgf/cm^2$. The backing can have a tensile strength at 100% elongation (double its original length) of at least 200 $kgf/cm^2$, at least 300 $kgf/cm^2$, or at least 350 $kgf/cm^2$. The tensile strength of the backing can be up to 900 $kgf/cm^2$, up to 700 $kgf/cm^2$, or up to 550 $kgf/cm^2$. Backings with these properties can provide various options and advantages, further described in U.S. Pat. No. 6,183,677 (Usui et al.).

Optionally, the backing may have at least one of a saturant, a presize layer and/or a backsize layer. The purpose of these materials is typically to seal the backing and/or to protect yarn or fibers in the backing. If the backing is a cloth material, at least one of these materials is typically used. The addition of the presize layer or backsize layer may additionally result in a smoother surface on either the front and/or the back side of the backing. Other optional layers known in the art may also be used, as described in U.S. Pat. No. 5,700,302 (Stoetzel et al.).

Abrasive Layers

The abrasive layer, in a broadest sense, is a layer containing a hard mineral that serves to abrade the workpiece. In FIGS. 1-4, the abrasive layer is a coated abrasive film that includes a plurality of abrasive particles 114 secured to a plurality of hardened resin layers. The abrasive particles 114 are adhesively coupled to the backing by implementing a sequence of coating operations involving a hardenable make coat 116 and size coat 118. It is common for the make coat 116 to include a curable polymeric resin in which the abrasive particles 114 are at least partially embedded and the size coat 118 to include the same or a different curable polymeric resin that is disposed on the make coat 116.

Advantageously, the abrasive particles 114 are partially or fully embedded in respective make and size coats 116, 118 in close proximity to the surface of the abrasive article 100, allowing the abrasive particles 114 to easily come into frictional contact with the workpiece when the abrasive article 100 is rubbed against the workpiece.

The abrasive particles 114 are not limited and may be composed of any of a wide variety of hard minerals known in the art. Examples of suitable abrasive particles include, for example, fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles, silica, iron oxide, chromia, ceria, zirconia, titania, tin oxide, gamma alumina, and combinations thereof. The alumina abrasive particles may contain a metal oxide modifier. The diamond and cubic boron nitride abrasive particles may be monocrystalline or polycrystalline.

There is almost always some range or distribution of abrasive particle sizes. Such a distribution can be characterized by its median particle size. For instance, the number median particle size of the abrasive particles may range from between 0.001 and 300 micrometers, between 0.01 and 250 micrometers, or between 0.02 and 100 micrometers.

An alternative abrasive layer is shown in FIG. 5. In this embodiment, the abrasive layer 512 is comprised of discrete islands of an abrasive composite. Such a composite can be made by uniformly mixing abrasive particles with a binder to form a viscous slurry. This slurry can then be cast and appropriately hardened (for example, using a thermal or radiation curing process) onto a backing 510 to afford the abrasive layer 512, as shown in the figure.

In a preferred embodiment, the abrasive slurry is used to form a structured abrasive. Structured abrasives can be made by mixing abrasive particles and a hardenable precursor resin in a suitable binder resin (or binder precursor) to form a slurry, casting the slurry between the underlying film and a mold having tiny geometric cavities, and then hardening the binder. After hardening, the resulting abrasive coating is molded into a plurality of tiny, precisely shaped abrasive composite structures affixed to the underlying film. The hardening of the binder can be achieved by a curing reaction triggered by heat or exposure to actinic radiation. Examples of actinic radiation include, for example, an electron beam, ultraviolet light, or visible light.

Supersize Coats

In general, the supersize coat is the outermost coating of the abrasive article and directly contacts the workpiece during an abrading operation. The supersize coat has a composition that acts to reduce the loading of swarf around the abrasive particles and improve the overall cut performance of the abrasive article.

The provided supersize coats contain a metal salt of a long-chain fatty acid. In preferred embodiments, the metal salt of a long-chain fatty acid is a stearate (i.e., a salt of stearic acid). The conjugate base of stearic acid is $C_{17}H_{35}COO^-$, also known as the stearate anion. Useful stearates include calcium stearate, zinc stearate, and combinations thereof.

The supersize coats of the present disclosure further contain clay particles that are dispersed in the supersize coat. The clay particles are preferably uniformly mixed with a metal salt of a long chain fatty acid, as described above. The clay bestows unique advantageous properties to the abrasive article, such as improved optical clarity and improved cut performance. It was also discovered that the inclusion of clay particles can enable cut performance to be sustained for longer periods of time relative to supersize coats in which the clay additive is absent. If the optical clarity of the supersize coat is limiting, the addition of clay enables thicker supersize coats to be used, thereby further enhancing abrasive performance.

The clay particles can be present in an amount of at least 0.01 percent, at least 0.05 percent, at least 0.1 percent, at least 0.15 percent, or at least 0.2 percent by weight based on the normalized weight of the supersize coat. Further, the clay particles can be present in an amount of up to 99 percent, up to 50 percent, up to 25 percent, up to 10 percent, or up to 5 percent by weight based on the normalized weight of the supersize coat.

Useful clay particles can have particle sizes that vary over a very wide range. For example, the median particle size can be at least 0.01 micrometers, at least 0.02 micrometers, or at least 0.1 micrometers. The individual clay particles can have a median particle size of up to 100 micrometers, up to 10 micrometers, or up to 1 micrometer.

The unique physical properties of many useful clay materials relate to their layered platelet-like structures. Such particles can have a median aspect ratio of at least 10, at least 15, at least 20, at least 50, at least 75, or at least 100. Further, the median aspect ratio can be up to 10,000, up to 8000, up to 6000, up to 4000, up to 2000, or up to 1000.

The clay particles may include particles of any known clay material. Such clay materials include those in the geological classes of the smectites, kaolins, illites, chlorites, serpentines, attapulgites, palygorskites, vermiculites, glauconites, sepiolites, and mixed layer clays. Smectites in particular include montmorillonite (e.g., a sodium montmorillonite or calcium montmorillonite), bentonite, pyrophyllite, hectorite, saponite, sauconite, nontronite, talc, beidellite, and volchonskoite. Specific kaolins include kaolinite, dickite, nacrite, antigorite, anauxite, halloysite, indellite and chrysotile. Illites include bravaisite, muscovite, paragonite, phlogopite and biotite. Chlorites can include, for example, corrensite, penninite, donbassite, sudoite, pennine and clinochlore. Mixed layer clays can include allevardite and vermiculitebiotite. Variants and isomorphic substitutions of these layered clays may also be used.

Layered clay materials may be either naturally occurring or synthetic. Exemplary clay materials include natural and synthetic hectorites, montmorillonites and bentonites. Examples of montmorillonite and bentonite clays include those clays available from Altana AG, Wesel, Germany, under the trade designations "CLOISITE", "MINERAL COLLOID", "NANOFIL", "GELWHITE", and "OPTIGEL" (e. g., "MINERAL COLLOID BP", "CLOISITE NA+", "NANOFIL 116", and "OPTIGEL CK"), as well as those clays available from R.T. Vanderbilt, Murray, Ky., under the trade designation "VEEGUM" (e.g., "VEEGUM PRO" and "VEEGUM F"), and clay available from Nanocor, Inc., Hoffman Estates, Il., under the trade designation "NANOMER." Examples of hectorite clays include the commercially available clays available from Altana AG under the trade designation "LAPONITE".

Other clay particles may be composed of vermiculite clays, such as those commercially available from Specialty Vermiculite Corp., Enoree, SC, under the trade designations "VERMICULITE", "MICROLITE", "VERXITE", and "ZONOLITE".

Natural clay minerals often exist as layered silicate minerals. A layered silicate mineral has $SiO_4$ tetrahedral sheets arranged into a two-dimensional network structure. A 2:1 type layered silicate mineral has a laminated structure of several to several tens of silicate sheets having a three layered structure in which a magnesium octahedral sheet or an aluminum octahedral sheet is interposed between a pair of silica tetrahedral sheets.

Particular silicates include hydrous silicate, layered hydrous aluminum silicate, fluorosilicate, mica-montmorillonite, hydrotalcite, lithium magnesium silicate and lithium magnesium fluorosilicate. Substituted variants of lithium magnesium silicate are also possible, where the hydroxyl group is partially substituted with fluorine, for example. Lithium and magnesium may also be partially substituted by aluminum. More broadly, the lithium magnesium silicate may be isomorphically substituted by any member selected from the group consisting of magnesium, aluminum, lithium, iron, chromium, zinc and mixtures thereof.

Synthetic hectorite is commercially available from Altana AG under the trade designation "LAPONITE". There are many grades or variants and isomorphous substitutions of LAPONITE, including those synthetic hectorites available under the trade designations "LAPONITE B", "LAPONITE S", "LAPONITE XLS", "LAPONITE RD", "LAPONITE XLG", "LAPONITE S482", and "LAPONITE RDS".

It is possible that clay materials provide particular frictional and static charge accumulation properties that can both impact swarf loading and abrasives performance. In the former case, the clay particles in the supersize coat can alleviate localized frictional heating known to increase swarf coalescence during an abrading operation. In the latter case, the clay particles can disrupt the electrostatic attraction that normally occurs between the abrasive article 100 and swarf particles.

As an optional additive, abrasive performance may be further enhanced by nanoparticles (i.e., nanoscale particles) interdispersed with the clay particles of the supersize coat. Useful nanoparticles include, for example, nanoparticles of metal oxides, such as zirconia, titania, silica, ceria, alumina, iron oxide, vanadia, zinc oxide, antimony oxide, tin oxide, and alumina-silica. The nanoparticles can have a median particle size of at least 1 nanometer, at least 1.5 nanometers, or at least 2 nanometers. The median particle size can be up to 200 nanometers, up to 150 nanometers, up to 100 nanometers, up to 50 nanometers, or up to 30 nanometers.

The nanoparticles can have any of a number of different particle size distributions. In some embodiments, the nanoparticles have a $D_{90}/D_{50}$ particle size ratio of at least 1.1, at least 1.2, at least 1.3, or at least 1.4. In some embodiments, the nanoparticles have a $D_{90}/D_{50}$ particle size ratio of up to 5, up to 4, up to 3, up to 2, or up to 1.8.

In some embodiments, the nanoparticles are sintered to form nanoparticle agglomerates. For example, the nanoparticles may be comprised of fumed silica in which primary silica particles are sintered to provide silica particles aggregated into chains.

The supersize coat 122 can be formed, in some embodiments, by providing a supersize composition in which the components are dissolved or otherwise dispersed in a suitable solvent. Preferably, the solvent is water. This supersize dispersion may include one or more polymeric binders (not to be confused with any binders present in the abrasive layer), emulsifying agents, and curing agents. These components are also preferably soluble or miscible in the solvent.

Optionally, the polymeric binder is a carboxy-functional styrene-acrylic resin.

Once mixed, the supersize dispersion can be coated onto the underlying layers of the abrasive article 100 and cured (i.e., hardened) either thermally or by exposure to actinic radiation at suitable wavelengths to activate the curing agent.

Any known method can be used to coat the dispersion above onto the supersize coat. In exemplary embodiments, the dispersion is applied by spray coating at a constant pressure to achieve a pre-determined coating weight. Alternatively, a knife coating method where the coating thickness is controlled by the gap height of the knife coater could be used.

Attachment Layers

An attachment layer can be affixed to the backing to help secure the abrasive article to a sanding block, power tool, or even the hand of an operator. In FIG. 2, the attachment layer 230 is comprised of a pressure-sensitive adhesive. The attachment layer can also use a mechanical retention mechanism. In FIG. 3, the attachment layer 330 is comprised of a fibrous material, such as a scrim or non-woven material forming half of a hook and loop attachment system. The other half can be provided, for example, on a sanding block or the movable chuck of a power tool. Such attachment systems are advantageous because they allow the abrasive article to be easily replaced when worn out.

Additional options and advantages of these abrasive articles are described in U.S. Pat. Nos. 4,988,554 (Peterson, et al.), 6,682,574 (Carter, et al.), 6,773,474 (Koehnle et al.), and 7,329,175 (Woo et al.).

While not intended to be exhaustive, particular exemplary embodiments of the provided abrasive articles, compositions and methods are set out as follows:

1. An abrasive article comprising a plurality of layers, in the following order: a backing; an abrasive layer; and a supersize coat comprising a metal salt of a long-chain fatty acid and having clay particles dispersed therein.
2. The abrasive article of embodiment 1, wherein the abrasive layer comprises: a make coat comprising a first polymeric resin and a plurality of abrasive particles at least partially embedded in the first polymeric resin; and a size coat disposed on the make coat and comprising a second polymeric resin.
3. The abrasive article of embodiment 1, wherein the abrasive layer comprises a plurality of abrasive composites that are precisely shaped.
4. The abrasive article of embodiment 3, wherein the abrasive composites are molded from an abrasive slurry.
5. The abrasive article of any one of embodiments 1-4, wherein the clay particles are present in an amount of from 0.01 percent to 99 percent by weight based on the normalized weight of the supersize coat.

6. The abrasive article of embodiment 5, wherein the clay particles are present in an amount of from 0.1 percent to 25 percent by weight based on the normalized weight of the supersize coat.
7. The abrasive article of embodiment 6, wherein the clay particles are present in an amount of from 0.2 percent to 5 percent by weight based on the normalized weight of the supersize coat.
8. The abrasive article of any one of embodiments 1-7, wherein the clay particles comprise a layered silicate.
9. The abrasive article of embodiment 8, wherein the layered silicate comprises a montmorillonite.
10. The abrasive article of embodiment 9, wherein the montmorillonite comprises a sodium montmorillonite, calcium montmorillonite, or combination thereof
11. The abrasive article of any one of embodiments 1-10, wherein the clay particles have a median particle size of from 0.01 micrometers to 100 micrometers.
12. The abrasive article of embodiment 11, wherein the clay particles have a median particle size of from 0.02 micrometers to 10 micrometers.
13. The abrasive article of embodiment 12, wherein the clay particles have a median particle size of from 0.1 micrometers to 1 micrometer.
14. The abrasive article of any one of embodiments 1-13, wherein the clay particles have a median aspect ratio of from 10 to 10,000.
15. The abrasive article of embodiment 14, wherein the clay particles have a median aspect ratio of from 20 to 1000.
16. The abrasive article of embodiment 15, wherein the clay particles have a median aspect ratio of from 100 to 1000.
17. The abrasive article of any one of embodiments 1-16, wherein the supersize coat further comprises silica nanoparticles.
18. The abrasive article of embodiment 17, wherein the silica nanoparticles comprise sintered silica nanoparticles.
19. The abrasive article of embodiment 17 or 18, wherein the silica nanoparticles have a median particle size of from 1 nanometer to 200 nanometers.
20. The abrasive article of embodiment 19, wherein the silica nanoparticles have a median particle size of from 2 nanometers to 100 nanometers.
21. The abrasive article of embodiment 20, wherein the silica nanoparticles have a median particle size of from 2 nanometers to 30 nanometers.
22. The abrasive article of any one of embodiments 17-21, wherein the silica nanoparticles have a D9o/D5o particle size ratio of from 1.1 to 5.
23. The abrasive article of embodiment 22, wherein the silica nanoparticles have a $D_{90}/D_{50}$ particle size ratio of from 1.1 to 2.
24. The abrasive article of embodiment 23, wherein the silica nanoparticles have a $D_{90}/D_{50}$ particle size ratio of from 1.4 to 1.8.
25. The abrasive article of any one of embodiments 1-24, wherein the metal salt of a long-chain fatty acid comprises a stearate.
26. The abrasive article of embodiment 25, wherein the stearate comprises calcium stearate, zinc stearate, or a combination thereof.
27. The abrasive article of any one of embodiments 1-26, wherein the supersize coat further comprises a polymeric binder.
28. The abrasive article of embodiment 27, wherein the polymeric binder comprises a carboxy-functional styrene-acrylic resin.
29. The abrasive article of any one of embodiments 1-28, wherein the backing comprises paper, polymeric film, polymeric foam, or a combination thereof.
30. The abrasive article of embodiment 29, wherein the backing comprises a polymeric film and the polymeric film comprises polyurethane rubber.
31. The abrasive article of any one of embodiments 1-30, further comprising an attachment layer coupled to a major surface of the backing opposite the abrasive layer.
32. The abrasive article of embodiment 31, wherein the attachment layer comprises a pressure-sensitive adhesive.
33. The abrasive article of embodiment 32, wherein the attachment layer comprises part of a hook and loop attachment mechanism.
34. The abrasive article of embodiment 32, wherein the attachment layer comprises a plurality of protrusions extending outwardly from the backing, the protrusions comprising a polymer having a Shore A hardness ranging from 5 to 90.
35. A supersize composition comprising: a metal salt of a long-chain fatty acid; clay particles; and a solvent.
36. The supersize composition of embodiment 35, wherein the metal salt of a long-chain fatty acid comprises a stearate.
37. The supersize composition of embodiment 35 or 36, further comprising a polymeric binder.
38. The supersize composition of embodiment 37, wherein the polymeric binder comprises a carboxy-functional styrene-acrylic resin.
39. A method of making an abrasive article comprising: dispersing in a solvent the following components to provide a dispersion: clay particles; a metal salt of a long-chain fatty acid; and optionally, a polymeric binder; and coating the dispersion onto an abrasive layer.
40. The method of embodiment 39, wherein the abrasive layer is disposed on a backing.

EXAMPLES

Objects and advantages of this disclosure are further illustrated by the following non-limiting examples, but the particular materials and amounts thereof recited in these examples, as well as other conditions and details, should not be construed to unduly limit this disclosure.

The following abbreviations are used to describe the examples:

° C.: degrees Centigrade
cm: centimeter
cm/s: centimeters per second
ctg. wt.: coating weight
$g/m^2$: grams per square meter
in/s: inches per second
Kg: kilogram
KPa: kilopascal
lb: pound
min: minute
mL: milliliter
psi: pounds per square inch
rpm: revolutions per minute
sec: second
wt %: weight percent Unless stated otherwise, all reagents were obtained or are available from chemical vendors such as Sigma-Aldrich Company, St. Louis, Missouri, or may be synthesized by known methods. Unless otherwise reported, all ratios are by weight.

Abbreviations for materials and reagents used in the examples are as follows:

J-89: An aqueous, non-film forming, styrene acrylic emulsion, obtained under the trade designation "JONCRYL J89" from BASF Company, Ludwigshafen, Germany.

J-1665: Obtained under the trade designation "JONCRYL J-1665" from BASF Company.

MMC-B: A natural montmorillonite clay, obtained under the trade designation "BENTOLITE-L" from BYK-Chemie GmbH, Wesel, Germany.

MMC-Na: A natural montmorillonite clay, obtained under the trade designation "CLOISITE-Na+" from BYK-Chemie GmbH.

MMC-O: A natural montmorillonite clay, obtained under the trade designation "OPTIGEL-WH" from BYK-Chemie GmbH.

ST-1: A 40.9 wt % aqueous zinc stearate soap dispersion obtained under trade designation "EC994C" from eChem Ltd, Leeds, United Kingdom.

ST-2: An aqueous 39-41 wt % zinc stearate soap dispersion, obtained under the trade designation "EC1696" from eChem Ltd.

ST-3: An aqueous calcium stearate dispersion, obtained under the trade designation "LOXANOL S233" from Geospecialty Chemical Company, Harrion, N.J.

ST-4: An aqueous 40.9 wt % calcium stearate/8 wt % styrene acrylic resin soap dispersion.

Clay Dispersions

CD-1

3.5 parts MMC-Na was added to 96.5 parts deionized water at 21° C. in a container and rolled for 48 hours until homogeneously dispersed using a bench top roller, obtained from Wheaton Industries, Inc.

CD-2

33.3 parts MMC-B was added to 66.7 parts deionized water at 21° C. in a container and rolled for 48 hours until homogeneously dispersed using the bench top roller.

CD-3

10.0 parts MMC-O was added to 90.0 parts deionized water at 21° C. in a container and rolled for 48 hours until homogeneously dispersed using the bench top roller.

Supersize Dispersions

Aqueous supersize dispersions were prepared by adding a stearate dispersion, deionized water and, optionally, a styrene acrylic binder and a clay dispersion, to a container according to the compositions listed in Table 1. The composition was then homogeneously dispersed by rolling for 48 hours at 21° C. by means of a bench top roller, obtained from Wheaton Industries, Inc.

TABLE 1

| | Stearate | | Binder | | Clay Dispersion | | Deionized Water | Clay |
|---|---|---|---|---|---|---|---|---|
| Supersize Dispersion | Type | Parts By Wt. | Type | Parts By Wt. | Type | Parts By Wt. | (Parts By Wt.) | Content (Wt %) |
| SSD-1 | ST-1 | 85.0 | None | 0 | None | 0 | 15.0 | 0 |
| SSD-2 | ST-1 | 85.0 | None | 0 | CD-1 | 15.0 | 0 | 0.53 |
| SSD-3 | ST-1 | 85.0 | None | 0 | CD-2 | 7.0 | 8.0 | 2.33 |
| SSD-4 | ST-1 | 85.0 | None | 0 | CD-3 | 15.0 | 0 | 1.50 |
| SSD-5 | ST-2 | 85.0 | None | 0 | None | 0 | 15.0 | 0 |
| SSD-6 | ST-2 | 85.0 | None | 0 | CD-1 | 15.0 | 0 | 0.53 |
| SSD-7 | ST-3 | 78.0 | J1696 | 6.0 | None | 0 | 16.0 | 0 |
| SSD-8 | ST-3 | 78.0 | J1665 | 6.0 | CD-1 | 16.0 | 0 | 0.56 |
| SSD-9 | ST-3 | 78.0 | J1665 | 6.0 | CD-2 | 6.0 | 10.0 | 2.00 |
| SSD-10 | ST-3 | 78.0 | J1665 | 6.0 | CD-3 | 16.0 | 0 | 1.60 |
| SSD-11 | ST-4 | 69.6 | J89 | 12.2 | None | 0 | 18.2 | 0 |

The following commercially available coated abrasives, obtained from 3M Company, St. Paul, Minn., were manufactured without the stearate supersize and are identified as the following experimental coated abrasive substrates, converted to 8 by 12 inch (20.32 by 30.48 cm) sheets:

EX-P240: A grade P240 coated abrasive

EX-P600: A grade P600 coated abrasive

EX-P1200: A grade P1200 coated abrasive

It is to be understood that, to one of ordinary skill in the art, the stearate supersize on a commercially available coated abrasive sheet could be removed merely by gently brushing off said supersize using a dilute aqueous soap solution.

A spray gun, model "ACCUSPRAY HG14", obtained from 3M Company, mounted on a robotic arm at a distance of 12 inches (30.48 cm) from the abrasive sheet, was used to uniformly apply the supersize dispersion over the abrasive surface at an inline pressure of 20 psi (137.9 kPa), then dried by means of a heat gun.

Evaluations

Loop attachment material was then laminated to the backside of the coated abrasive material and converted into either 6-inch (15.24 cm), or 150 mm, diameter discs.

Cut Test 1

Abrasive performance testing was performed on an 18 inches by 24 inches (45.7 cm by 61 cm) black painted cold roll steel test panels having "NEXA OEM" type clearcoat, obtained from ACT Laboratories, Inc., Hillsdale, MI. Sanding was performed using a random orbit sander, model "28701 ELITE RANDOM ORBITAL SANDER", from 3M Company, operating at a line pressure of 90 psi (620.5 KPa) and 5/16-inch (7.94 mm) stroke. For testing purposes, the abrasive discs were attached to a 6-inch (15.2 cm) interface pad, which was then attached to a 6-inch (15.2 cm) backup pad, both commercially available under the trade designations "HOOKIT INTERFACE PAD, PART NO. 05777" and "HOOKIT BACKUP PAD, PART NO. 05551," from 3M Company. Each abrasive disc was tested for 3 minutes, in 1 minute intervals. The test panel was weighed before and after sanding, and where the difference in mass is the measured cut, reported as grams per interval. Two abrasive discs were tested per each Comparative and Example.

Cut Test 2

A 6-inch (15.24 cm) diameter abrasive disc was mounted on a 6 inch (15.24 cm) diameter, 25 hole, backup pad, Part No. "05865", obtained from 3M Company. This assembly was then attached to a dual action axis of a servo controlled motor, disposed over an X-Y table, with the "Nexa OEM" clearcoated cold roll steel test panel secured to the table. The servo controlled motor was run at 7200 rpm, and the abrasive article urged at an angle of 2.5 degrees against the panel at a load of 12 lbs (5.44 Kg) for grade EX-P1200 and 15 lbs (6.80 Kg) for grade EX-P600. The tool was then set to traverse at a rate of 20 in/s (50.8 cm/s) along the width of the panel; and a traverse along the length of the panel at a rate of 5 in/s (12.7 cm/s). Seven such passes along the length of the panel were completed per 30 second cycle. EX-P1200 samples were subjected to one cycle; EX-P600 samples were subjected to 3 cycles. The mass of the panel was measured before and after each cycle to determine the total mass lost in grams for each cycle, as well as a cumulative mass loss at the end of 3 cycles. Three abrasive discs were tested per each Comparative and Example.

Color Measurement

L*a*b* values of supersize coated abrasive sheets were measured using a model "Mini Scan EZ 4500L" spectrophotometer, obtained from Hunter Associates Laboratories, Inc., Reston, Va. Measurements were taken under D65 illuminant at 10 degree observer, and are reported as an average of four measurements per sample.

Differences in L*a*b* between a first color specimen (Li*ai*bi*) and a second color specimen (L2*a2*b2) were characterized according to the CIELAB metric ΔE. As used herein, ΔE is defined as:

$$\Delta E^* = \sqrt{(L_2^* - L_1^*)^2 + (a_2^* - a_1^*)^2 + (b_2^* - b_1^*)^2}$$

In one convention, a ΔE* of about 2.3 corresponds to a just noticeable difference in color.

Examples 1-4 and Comparatives A-B

Supersize dispersions 1-6 were spray coated onto abrasive sheets of EX-P1200 and dried for 2 hours at 21° C., resulting in an opaque dry supersize coating weight of 10 g/m$^2$. The coated abrasive sheets were then heated to approximately 135° C. by means of a heat gun, causing the supersize to change from opaque to clear. The samples were then evaluated according to Cut Test 2, the results of which are listed in Table 2.

TABLE 2

| | | Supersize Dispersion | | | | Total Cut |
|---|---|---|---|---|---|---|
| | Abrasive Substrate | Supersize Dispersion | Stearate Dispersion | Clay Dispersion | Styrene Acrylic | @ 30 sec. (grams) |
| Comparative A | EX-P1200 | SSD-1 | ST-1 | None | None | 0.25 |
| Example 1 | EX-P1200 | SSD-2 | ST-1 | CD-1 | None | 0.30 |
| Example 2 | EX-P1200 | SSD-3 | ST-1 | CD-2 | None | 0.28 |
| Example 3 | EX-P1200 | SSD-4 | ST-1 | CD-3 | None | 0.28 |
| Comparative B | EX-P1200 | SSD-5 | ST-2 | None | None | 0.31 |
| Example 4 | EX-P1200 | SSD-6 | ST-2 | CD-1 | None | 0.33 |

Examples 5-6 and Comparatives C-F

Supersize dispersions SSD-7, SSD-8, SSD-10 and SSD-11 were spray coated onto EX-P600 abrasive sheets and dried as generally described in Example 1 and the L*a*b* values of the dried coatings were measured. As listed in Table 3, the difference in L*a*b* values compared to the EX-P600 abrasive sheet without supersize (Comparative C), are reported as CIELAB ΔE* values.

TABLE 3

| | Supersize Dispersion | | | | | Color Measurements | | | |
|---|---|---|---|---|---|---|---|---|---|
| | Supersize Dispersion | SSD Ctg. Wt. (g/m$^2$) | Stearate Dispersion | Clay Dispersion | Styrene Acrylic Binder | L* | a* | b* | ΔE* |
| Comparative C | None | 0 | None | None | None | 62.7 | 8.1 | 32.1 | 0 |
| Comparative D | SSD-11 | 4 | ST-4 | None | J1696 | 66.3 | 7.2 | 20.2 | 12.5 |
| Comparative E | SSD-11 | 10 | ST-4 | None | J1696 | 67.4 | 6.7 | 17.5 | 15.4 |
| Comparative F | SSD-7 | 10 | ST-3 | None | J1696 | 66.4 | 6.8 | 21.4 | 11.4 |
| Example 5 | SSD-8 | 10 | ST-3 | CD-1 | J1696 | 64.3 | 7.6 | 27.5 | 4.9 |
| Example 6 | SSD-10 | 10 | ST-3 | CD-3 | J1696 | 65.8 | 7.1 | 23.7 | 9.0 |

Example 7 and Comparatives G-I

Supersize dispersions SSD-7, SSD-8 and SSD-11 were spray coated onto abrasive sheet EX-P240, dried for 2 hours at 21° C. and evaluated according to Cut Test 1. Results are reported in Table 4.

TABLE 4

| | Supersize Dispersion | | | | | Cut Test 1 (grams) | | |
|---|---|---|---|---|---|---|---|---|
| | | SSD Ctg. | | | Styrene | | | |
| Sample | Supersize Dispersion | Wt. ($g/m^2$) | Stearate Dispersion | Clay Dispersion | Acrylic Binder | $1^{st}$ min | $2^{nd}$ min | Total |
| Comparative G | SSD-11 | 10.3 | ST-4 | None | J1696 | 5.77 | 3.63 | 9.40 |
| Comparative H | SSD-11 | 14.4 | ST-4 | None | J1696 | 7.39 | 4.96 | 12.35 |
| Comparative I | SSD-7 | 15.7 | ST-3 | None | J1696 | 7.11 | 5.37 | 12.48 |
| Example 7 | SSD-8 | 15.7 | ST-3 | CD-1 | J1696 | 6.89 | 5.86 | 12.65 |

Example 8 and Comparatives J-K

Supersize dispersions SSD-7, SSD-8 and SSD-11 were spray coated onto abrasive sheet EX-P600, dried for 2 hours at 21° C. and evaluated according to Cut Test 2. Results are reported in Table 5.

TABLE 5

| | | SSD | Cut Test 2 | | | | |
|---|---|---|---|---|---|---|---|
| | | Ctg. | Cut (grams) | | | | |
| | Supersize Dispersion | Wt. ($g/m^2$) | 0-30 sec | 30-60 sec | 60-90 sec | Total Cut | Cut Life |
| Comparative J | SSD-11 | 5.2 | 1.41 | 0.67 | 0.41 | 2.49 | 0.29 |
| Comparative K | SSD-11 | 11.0 | 1.21 | 0.90 | 0.68 | 2.79 | 0.56 |
| Comparative L | SSD-7 | 9.4 | 1.17 | 0.94 | 0.83 | 2.94 | 0.71 |
| Example 8 | SSD-8 | 11.4 | 1.10 | 0.94 | 0.90 | 2.94 | 0.82 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. An abrasive article comprising a plurality of layers, in the following order:

a backing;

an abrasive layer; and a supersize coat comprising a metal salt of a long-chain fatty acid and having clay particles dispersed therein, wherein the supersize coat does not include polymeric binders.

2. The abrasive article of claim 1, wherein the abrasive layer comprises:

a make coat comprising a first polymeric resin and a plurality of abrasive particles at least partially embedded in the first polymeric resin; and a size coat disposed on the make coat and comprising a second polymeric resin.

3. The abrasive article of claim 1, wherein the abrasive layer comprises a plurality of abrasive composites that are precisely shaped.

4. The abrasive article of claim 3, wherein the abrasive composites are molded from an abrasive slurry.

5. The abrasive article of claim 1, wherein the clay particles comprise a layered silicate.

6. The abrasive article of claim 5, wherein the layered silicate comprises a montmorillonite.

7. The abrasive article of claim 6, wherein the montmorillonite comprises a sodium montmorillonite, calcium montmorillonite, or combination thereof.

8. The abrasive article of claim 1, wherein the metal salt of a long-chain fatty acid comprises a stearate.

9. The abrasive article of claim 8, wherein the stearate comprises calcium stearate, zinc stearate, or a combination thereof.

10. The abrasive article of claim 1, further comprising an attachment layer coupled to a major surface of the backing opposite the abrasive layer.

11. A supersize composition comprising:

a metal salt of a long-chain fatty acid;

clay particles; and a solvent, wherein the supersize composition does not include polymeric binders.

12. The supersize composition of claim 11, wherein the metal salt of a long-chain fatty acid comprises a stearate.

13. A method of making an abrasive article comprising:

dispersing in a solvent the following components to provide a dispersion:

clay particles; and a metal salt of a long-chain fatty acid;

coating the dispersion onto an abrasive layer; and curing the dispersion, wherein the dispersion does not include polymeric binders.

* * * * *